United States Patent [19]

Feather

[11] 4,210,323

[45] Jul. 1, 1980

[54] BODY ENGAGING EXERCISING DEVICE

[76] Inventor: Jack V. Feather, P.O. Box 1399, Pebble Beach, Calif. 93953

[21] Appl. No.: 907,098

[22] Filed: May 18, 1978

[51] Int. Cl.[2] ..... A63B 21/32

[52] U.S. Cl. ..... 272/137; 272/126

[58] Field of Search ..... 128/321, 322; 272/67, 272/68, 93, 125, 126, 130, 135–142, 143

[56] References Cited

U.S. PATENT DOCUMENTS

| | | | |
|---|---|---|---|
| 2,529,347 | 11/1950 | Mohler et al. | 272/137 |
| 3,174,343 | 3/1965 | Kasulis | 272/130 X |
| 3,349,621 | 10/1967 | Mullen | 272/141 X |
| 3,404,683 | 10/1968 | Eizenberg | 128/322 |
| 4,022,463 | 5/1977 | Scott | 272/136 |

FOREIGN PATENT DOCUMENTS

| | | | |
|---|---|---|---|
| 791616 | 9/1935 | France | 272/68 |
| 526253 | 9/1940 | United Kingdom | 272/68 |

*Primary Examiner*—Richard J. Apley
*Attorney, Agent, or Firm*—Bruce & McCoy

[57] ABSTRACT

A pair of pivoted rocker arms having body engaging surfaces on at least one pair of ends which can be actuated so that when two adjacent ends are moved toward each other the opposite ends move apart.

6 Claims, 7 Drawing Figures

FIG.—1
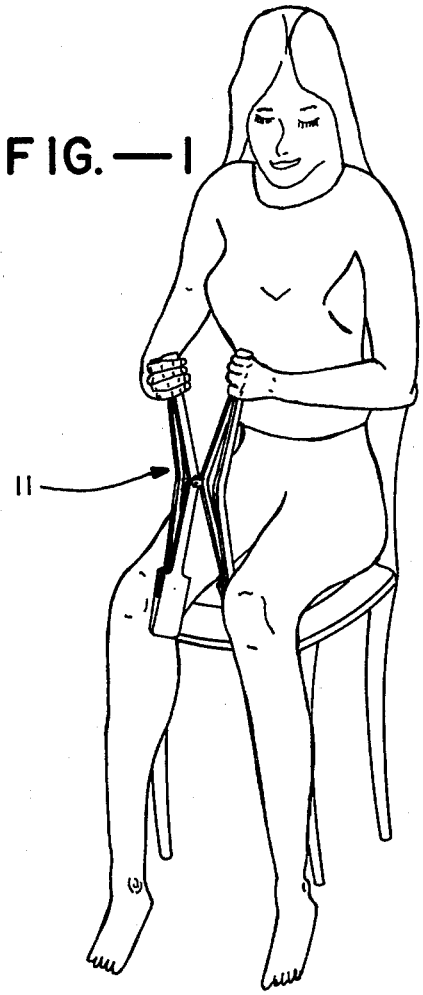
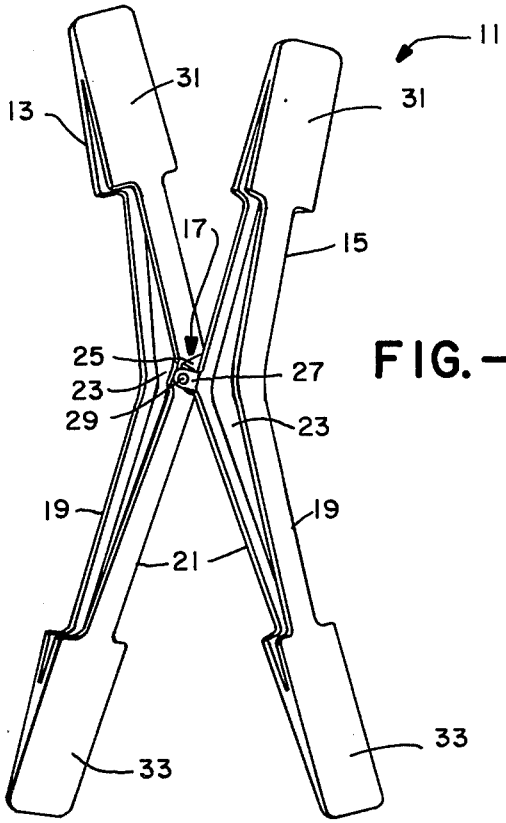
FIG.—2
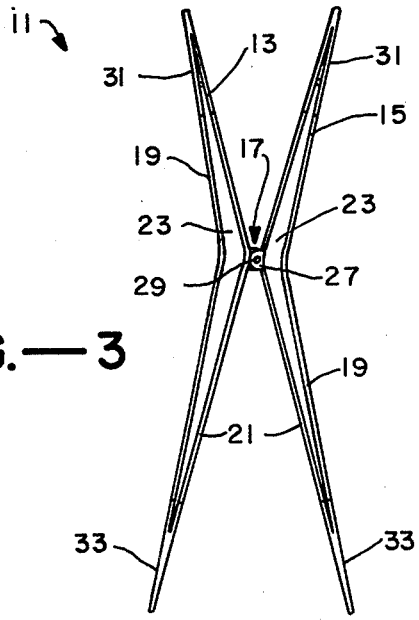
FIG.—3
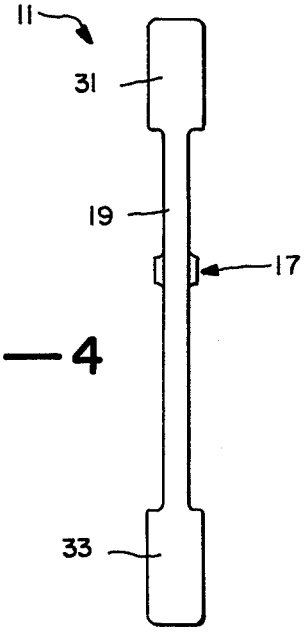
FIG.—4

BODY ENGAGING EXERCISING DEVICE

BACKGROUND OF THE INVENTION

1. Field of the Invention

The present invention relates to exercising devices and more particularly to a body engaging exercising device which is particularly adapted for exercising the chest and inner thigh muscles.

2. Description of the Prior Art

There are many types of exercisers available for affecting various portions of the human body including devices adapted for particularly exercising the thighs and some for particularly exercising the female bust. It has been found that the inner thigh and upper chest muscles are most effectively exercised when they are required to exert both positive pressure and negative resistance to a force. Positive pressure is required when a muscle acts to compress a force whereas negative resistance occurs when a muscle acts to restrain a force which is moving against it; for example, negative resistance would be needed in one's inner thigh leg muscles to restrain a force attempting to move the legs apart. An example of a bust exerciser which employs both positive pressure or negative resistance to effect exercise is the invention disclosed by Applicant's U.S. Pat. No. 3,497,216 for a Spring Type Bust Developer.

The inner thigh is one of the more difficult areas of the body to exercise and most of the available thigh exercisers operate to exercise the legs in a running or walking motion. Very few require squeezing motions such as one would employ in horseback riding. Even in horseback riding, however, the inner thigh muscles are not adequately exercised because squeezing the horse with the legs is purely isometric exercise. The muscles do not exert alternating positive pressure and negative resistance through a range of movement because the horse's body is not subject to compression.

There is a need for an exercising device which can be used to require either positive pressure or negative resistance for the inner thigh muscles and the chest muscles. There is likewise a need for an efficient and effective exercising device which will exercise these portions of the body simultaneously. There is also a need for an exercising device which can be constructed to provide varying degrees of resistance to the muscles and which can be used for more than one area of the body.

The present invention provides a solution to these problems by providing in one embodiment, an exerciser which allows the user to exert positive pressure and negative resistance in the inner thigh muscles in combination with or as a result of simultaneous alternating positive pressure and negative resistance in the chest muscles. Another embodiment of the present invention provides an exercising device with increased resistance for the muscles to overcome and which can be used to exercise either the chest muscles or the inner thigh muscles.

SUMMARY OF THE INVENTION

The present invention is a body engaging exercising device which includes a pair of rocker arms. The rocker arms are pivoted together at a common intermediate point along their length whereby as two adjacent ends of the rocker arms are moved together, the opposite ends are spread apart. The intermediate pivot point is disposed closer to one pair of ends of the rocker arms than to the other pair of ends. Body engaging surfaces are disposed on at least one pair of rocker arm ends at equal distances from the pivot point. These surfaces are generally planar with their planes being perpendicular to the plane of actuation of the rocker arms.

OBJECTS OF THE INVENTION

It is therefore an important object of the present invention to provide an exercising device which will exercise both the inner thigh muscles and the chest muscles.

It is also an important object of the present invention to provide an inner thigh exerciser which provides isotonic exercise to the inner thigh muscles by causing the muscles to exert both positive pressure and negative resistance.

It is another object of the present invention to provide an inner thigh exerciser which also concurrently exercises the chest muscles with positive pressure and negative resistance.

It is a further object of the present invention to provide an inner thigh exerciser and bust developer which is compact, small, lightweight, and inexpensive.

It is still a further object of the present invention to provide an exercising device which can be adapted to maximize the effects on different muscles.

And it is still another object of the present invention to provide an inner thigh and bust exerciser which can be used in any convenient location where a person can assume a sitting position.

Other objects and advantages of the invention will become apparent when a description of the invention is considered in conjunction with the appended drawings.

DESCRIPTION OF THE DRAWINGS

FIG. 1 is a perspective view of one of the preferred embodiments of the present invention being used in its preferred mode;

FIG. 2 is a detailed perspective view of the embodiment of FIG. 1;

FIG. 3 is a side elevational view thereof;

FIG. 4 is an end elevational view thereof;

DESCRIPTION OF THE PREFERRED EMBODIMENT

Figure 5:
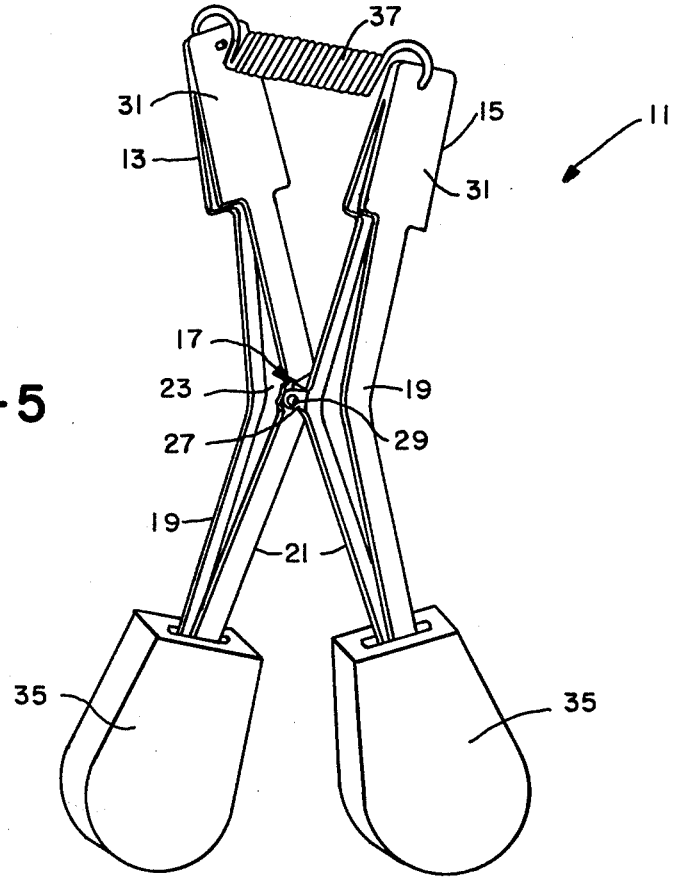
FIG. 5 is a perspective view of another embodiment of the present invention.

The present invention is a body engaging exercising device 11. It includes a pair of rocker arms 13, 15 which are pivoted together at a common intermediate point 17 along their length. As one pair of adjacent ends is held together, the other two ends are spread apart.

In the preferred embodiment, the rocker arms 13, 15 are of equal length and are formed with a bent configuration whereby the arms do not cross but interlock and bear against each other at the pivot point 17 which is disposed at the apex of the bends. In the preferred embodiment the rocker arms are approximately 17 inches (43.18 cm) long. These rocker arms are formed with an I-beam construction in cross section. This construction provides a rigid and durable device which yet can be made from a lightweight material such as a molded plastic. The flanges 19, 21 relating to the flanges of an I-beam are angled with respect to each other on the same rocker arm. The web portion is an integral interconnecting member 23 between the two angled flange portions of each rocker arm. The web portions of each rocker arm lie in generally the same plane.

In the preferred embodiment each of the rocker arms 13, 15 is bent to form a generally obtuse angle. The rocker arms are joined together at a pivot point 17 located at the apex of their bends. As used herein, the inner surface of the rocker arm refers to the side of the arm which is nearest the corresponding side of the opposed rocker arm and is the side upon which the pivot is disposed. The outer surface of a rocker arm faces away from the other rocker arm and forms a generally obtuse angle away from the pivot point. Thus in the preferred embodiment, at least one pair of rocker arm ends will be separated from each other at all times.

The angle formed by this bend may be different with respect to the flange 21 on the inner side of the rocker arm 13 or 15 from that of the flange 19 on the outer side but each angle will be between 120° and 170°. It is believed that bending the rocker arms to an angle in this range provides the optimal leverage desired in exercising both the chest muscles and the inner thigh muscles. In the preferred embodiment the angle of the rocker arm from the inside flange is approximately 143° and the angle as measured on the outer flange is approximately 154°.

The intermediate pivot point 17 of the rocker arms 13, 15 may be disposed at different locations along the length of the rocker arms depending on the mechanical advantage desired for any particular adaptation of the invention. In the preferred embodiment the pivot point is disposed closer to one pair of ends of the rocker arms than to the other pair of ends. Generally this intermediate pivot point will be at least one-twentieth the length of a rocker arm from its center. In one embodiment of this device the pivot point is displaced approximately $\frac{7}{8}$ inches (2.22 cm) from the center of the rocker arm. It is believed that the compression strength of the arm muscles acting on one pair of ends of the rocker arms will exceed that of the inner thigh muscles acting in opposition on the other ends. Thus in this embodiment a displacement of the pivot point 17 towards the ends of the rocker arms to be gripped by the hands creates a mechanical advantage for the leg muscles and tends to equalize the muscle capabilities and prevent overstressing or straining of the inner thigh muscles. It is anticipated that other embodiments employing spring means as described hereinafter may require other displacements and that in some instances the pivot point may be centered on the arms.

In the preferred embodiment the rocker arms 13, 15 have bearing blocks 25, 27, respectively, disposed at the apex of the bends which are secured together at a pivot point. One rocker arm 13 has a single bearing block 25 and the second rocker arm 15 has a pair of bearing blocks 27, each of said pair of bearing blocks being disposed on opposite sides of the single bearing block of the first rocker arm. The bearing blocks are interlocked by a pivot pin 29 which is journalled in the bearing blocks. The axis of rotation of the pin is perpendicular to the plane of actuation of the rocker arms.

Body engaging surfaces 31, 33 are disposed on at least one pair of rocker arm ends at equal distances from the pivot point 17. The body engaging surfaces are generally planar, the plane of these surfaces being perpendicular to the plane of actuation of the rocker arms when engaged with the hands or insides of the thighs of the user. The inner flanges 19 and outer flanges 21 of each rocker arm 13 or 15 are angled toward each other and become wider and meet at the ends in flat surfaces formed to engage the inner thighs or the hands. These surfaces also provide the structure upon which cushioned sleeves 35 may be mounted for greater comfort. The surfaces 31, 33 may instead be sculptured to provide a better grip. In one embodiment of the invention (not shown) handgrips are disposed on the shorter adjacent ends of the rocker arms and inner thigh engaging paddles are formed on the longer ends of the rocker arms for more comfortably engaging the inner thighs of the user adjacent the knees.

One embodiment of this invention 11 may be used as shown in FIG. 1 of the drawings. The user squeezes the body engaging surfaces 31 of the shorter pair of rocker arm portions together with the hands with sufficient force to cause the legs to spread apart. At the same time the legs keep a squeezing force on the body engaging surfaces 33 of the longer portions of the rocker arms. When the force exerted by the hands and arms is greater than that exerted by the thighs, the chest and arm muscles will be performing positive pressure and the inner thigh muscles which are being forced apart will be exerting negative resistance. The user may then reverse the process and exert greater force on the thigh-engaging rocker arm ends which causes the hand-engaging portions to separate against force, causing negative resistance in the chest muscles and positive pressure to be exerted by the inner thigh muscles. Thus both isometric and isotonic exercise can be performed with this invention and a single device can be used to effectively exercise a difficult-to-exercise area of the body, the inner thigh muscles, while concurrently exercising the chest muscles of the bust thereby obtaining a double benefit from one's exercise time.

Figure 6:
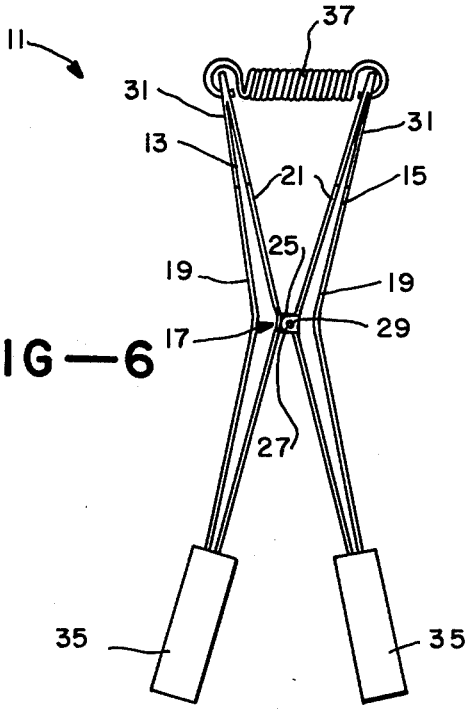
FIG. 6 is a side elevational view of the embodiment of FIG. 5.
Figure 7:
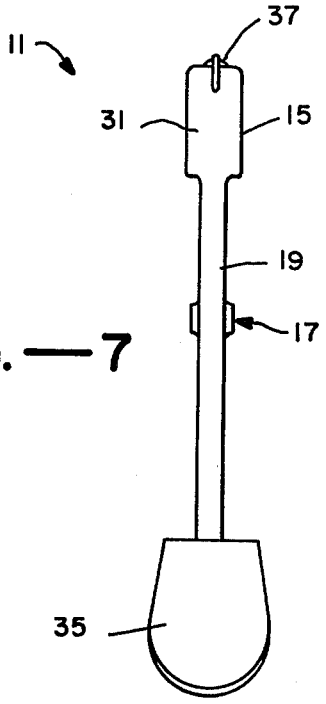
FIG. 7 is an end elevational view of the embodiment of FIG. 5.

In another embodiment of this invention spring means 37 are disposed between two adjacent portions of the rocker arms 13, 15 on the same side of the pivot point 17 to urge the body engaging surfaces away from each other to an open position whereby a user exercises by compressing said body engaging surfaces to overcome the urge of said spring means. In one variation of this embodiment, illustrated in FIGS. 5–7, the spring means may be disposed on one side of the pivot point and the body engaging surfaces disposed on the opposite ends of the rocker arm. In this variation the user may grip the body engaging surfaces 33 or cushioned sleeves 35 on the opposite ends of the rocker arms and compress them together against the spring means. With this embodiment of the invention the same device can be used to perform isometric or isotonic exercise by both the chest and arm muscles and the muscles of the inner thighs. In this embodiment the force of the spring selected and its position relative to the pivot point can be varied to achieve the desired effective force to be compressed by the user.

Yet another embodiment of this invention (not shown) utilizes spring means disposed between adjacent portions of the rocker arms on the same side of the pivot point as the body engaging surfaces to urge the adjacent portions apart so that the spring means must be compressed during exercise. In this embodiment body engaging surfaces may be disposed on both pairs of rocker arm ends and the spring means may be disposed closer to the pivot point so that the user may engage the ends separated by the spring means with the user's hands and place the opposite ends between the user's inner thighs.

When the user squeezes the ends having the spring means together, the opposite ends will be forcing the legs apart and providing negative resistance thereto. The operation could thereafter be reversed by placing the ends with the spring means between the legs. It is expected that this latter embodiment would be particularly useful where either set of muscles is more developed than the opposing ones and additional resistance is required to obtain further progress of the stronger muscles.

It can be seen from the foregoing description that the types and position of the springs means, as well as the lengths of the portions of the rocker arms from the pivot can be varied to achieve different desired effects. Each of the embodiments of the invention provide a single device which can be utilized to exercise either the inner thigh muscles or the muscles of the bust and with some variations of the device such exercise can be concurrent. This invention also provides a device which can be used to perform both isotonic and isometric exercise.

Thus, it will be seen from the foregoing description of the preferred embodiment of the invention that the objects and advantages of the invention attributable thereto can be readily achieved. While the invention has been described in considerable detail it is not to be limited to such details except as may be necessitated by the apended claims.

I claim:

1. A body engaging exercising device comprising a pair of bent rocker arms of equal length, each of said rocker arms being formed of one piece in cross section in an I-beam construction along the entire length of the arm with the web portions thereof lying in the same plane and the flange portions of each arm being angled with respect to each other and joined together at each end, each rocker arm being bent to form an obtuse angle, one of said rocker arms having a single bearing member integrally formed to the apex of its bend in a plane which bisects said apex and the other rocker arm having a pair of bearing members integrally formed to the apex of its bend in a plane which bisects said apex, each of said pair of bearing members being disposed on opposite sides of said single bearing member of the first rocker arm, said bearing members being interlocked at the pivot point by a pivot pin which is journalled in the bearing blocks, said pivot point being disposed between one-tenth and one-twentieth the length of the rocker arms from the center thereof, and body engaging surfaces disposed on at least one pair of rocker arm ends and integrally secured thereto, said body engaging surfaces being generally planar and formed to contact the hands or inner thighs of the user, the planes of said body engaging surfaces being generally perpendicular to the plane of actuation of the rocker arms.

2. A body engaging exercising device comprising a pair of generally straight rocker arms being bent into an angle of between 120° and 170°, each of said rocker arms being formed of one piece in an I-beam construction in cross-section, the flanges of said I-beam of each arm being angled with respect to each other such that the flanges meet and are integrally secured to each other at the ends of each rocker arm, each of said rocker arms having at least one bearing member integrally secured thereto, said bearing member being disposed at the apex of the angle of the rocker arm in a plane which bisects said angle and being interlocked by a pivot pin journalled in said bearing members, and body engaging surfaces disposed on at least one pair of rocker arm ends integrally formed therefrom, said body engaging surfaces being generally planar and formed to contact the hands or inner thighs of the user, the planes of said body engaging surfaces being generally perpendicular to the plane of actuation of the rocker arms.

3. A body engaging exercising device comprising a pair of opposed rocker arms each of said rocker arms being bent into an obtuse angle, the arms of said angle being straight from the apex of the bend along their length, said rocker arms being formed of one piece in an I-beam construction such that the webs of the I-beam are disposed in the plane of actuation of the rocker arms and the flanges of the I-beam on each side of the apex of the bend are angled towards each other and joined together at the end of each rocker arm, pivot means locking said rocker arms together at a point between one-tenth and one-twentieth the length of the arms from their midpoint, said pivot means comprising a single bearing member integrally formed from one rocker arm and projecting from the apex of the bend of said rocker arm in a plane which bisects said apex, a pair of bearing members integrally formed from the other rocker arm and projecting therefrom in a plane which bisects the apex of the rocker arm, bend each of said pair of bearing members disposed on opposite sides of said single bearing member, and a pivot pin journalled in the bearing members securing said means together, and generally planar body engaging surfaces disposed on at least one pair of rocker arm ends said body engaging surfaces being formed from the junction of the I-beam flanges of the rocker arm.

4. The exercising device of claim 1, 2 or 3 wherein spring means are disposed between two adjacent portions of said rocker arms on the same side of the pivot point to urge said body engaging surfaces away from each other to an open position whereby the user exercises by compressing said body engaging surfaces together to overcome the urge of said spring means.

5. The exercising device of claim 1, 2 or 3 wherein spring means are disposed between adjacent portions of said rocker arms on one side of the pivot point and the body engaging surfaces are disposed on the opposite ends of the rocker arms from the pivot point whereby said spring means is stretched during exercise.

6. The body engaging exercising device of claim 1, 2, or 3 wherein spring means are disposed between adjacent portions of said rocker arms on one side of the pivot point and the body engaging surfaces are disposed on the opposite ends of the rocker arms from the pivot point whereby said spring means is stretched during exercise and cushioned sleeves are disposed on said body engaging surfaces.

* * * * *